US009903215B2

(12) United States Patent
Soundiramourty et al.

(10) Patent No.: US 9,903,215 B2
(45) Date of Patent: Feb. 27, 2018

(54) COOLING PASSAGES FOR INNER CASING OF A TURBINE EXHAUST

(71) Applicant: General Electric Co., Schenectady, NY (US)

(72) Inventors: Sendilkumaran Soundiramourty, Bangalore (IN); Srinivas Pakkala, Chintalapudi (IN)

(73) Assignee: General Electric Company, Schenectady, NY (US)

( * ) Notice: Subject to any disclaimer, the term of this patent is extended or adjusted under 35 U.S.C. 154(b) by 818 days.

(21) Appl. No.: 14/301,507

(22) Filed: Jun. 11, 2014

(65) Prior Publication Data

US 2015/0361809 A1 Dec. 17, 2015

(51) Int. Cl.
*F01D 9/06* (2006.01)

(52) U.S. Cl.
CPC ..... *F01D 9/065* (2013.01)

(58) Field of Classification Search
None
See application file for complete search history.

(56) References Cited

U.S. PATENT DOCUMENTS

| | | | | |
|---|---|---|---|---|
| 6,578,363 | B2 | 6/2003 | Hashimoto et al. | |
| 7,004,720 | B2 * | 2/2006 | Synnott | F01D 9/041 415/115 |
| 7,373,773 | B2 | 5/2008 | Noda | |
| 7,493,769 | B2 | 2/2009 | Jangili | |
| 7,785,067 | B2 * | 8/2010 | Lee | F01D 9/04 415/116 |
| 8,727,725 | B1 * | 5/2014 | Liang | F01D 5/143 415/115 |
| 2010/0080698 | A1 * | 4/2010 | Flanagan | F01D 25/265 415/213.1 |
| 2012/0006028 | A1 * | 1/2012 | Lee | F01D 9/023 60/725 |
| 2012/0186260 | A1 * | 7/2012 | DiCintio | F01D 9/023 60/752 |
| 2013/0064647 | A1 | 3/2013 | Hashimoto | |
| 2013/0084172 | A1 | 4/2013 | Kasibhotla et al. | |

* cited by examiner

*Primary Examiner* — Carlos A Rivera
(74) *Attorney, Agent, or Firm* — Nixon & Vanderhye P.C.

(57) ABSTRACT

An inner casing assembly for a turbine including: an annular inner casing including cooling passages, wherein each passage extends through a wall of the inner casing from a source of cooling fluid to an outer surface of the wall of the inner casing, and struts extending outward from the outer surface of the inner casing wherein the cooling passages are arranged on the inner casing such that a pair of the cooling passages is on opposite sides of each of the struts, and the cooling passages in each pair are equidistant to the corresponding strut.

12 Claims, 9 Drawing Sheets

COOLING PASSAGES FOR INNER CASING OF A TURBINE EXHAUST

BACKGROUND OF THE INVENTION

The present invention generally relates to cooling of the exhaust section of a gas turbine, and, particularly, relates to cooling of the struts on a gas turbine inner casing in an exhaust section.

A gas turbine engine combusts a mixture of fuel and compressed air to generate hot combustion gases, which drives turbine blades to rotate a shaft in the exhaust section supported by bearings and casings. The rotation of the shaft may generate significant amounts of heat in the turbine. Also, the hot turbine exhaust gases flowing through an exhaust section may transfer heat to the exhaust casings in the exhaust section.

An inner casing in an exhaust section of a gas turbine is heated by the exhaust gas from the turbine engine. The inner casing may also experience thermal heating due to friction from the shaft in the casing. Inner casing in a turbine exhaust component may not be adequately and uniformly cooled due to differences in body mass throughout the inner casing, such as the flanges at the split line and at the roots of the struts connected to the inner casing. Uneven cooling of the struts may cause differences in thermal contraction and expansion in different areas of the inner casing, and induce damages associated with thermal stress.

Methods of cooling turbine exhaust casing components have been described using a flow of cooling fluids (e.g. ambient air) through the exhaust section. Cooling systems are disclosed in U.S. Pat. Nos. 7,493,769; 6,578,363; 7,373,773; 2013/0064647; and 2013/0084172.

BRIEF DESCRIPTION OF THE INVENTION

An inner casing cooling system has been conceived and is disclosed herein to provide cooling flow in a turbine exhaust section for uniform cooling of the roots of the struts and the split line flanges on the inner casing.

An inner casing assembly for a turbine is disclosed herein comprising: an annular inner casing including cooling passages, wherein each passage extends through a wall of the inner casing from a source of cooling fluid to an outer surface of the wall of the inner casing, and struts extending outward from the outer surface of the inner casing, wherein the cooling passages are arranged on the inner casing such that a pair of the cooling passages is on opposite sides of each of the struts, and the cooling passages in each pair are equidistant to the corresponding strut.

The cooling passages may include a pair of cooling passages on opposite sides of a split line extending in an axial direction through the outer surface of the inner casing and the pair of cooling passages on opposite sides of the split line are each equidistant from the split line. The cooling passages may not be equidistantly arranged around a circumference of the inner casing. The cooling passages may include cooling passages arranged in annular arrays in front of and behind the struts along an axis of the inner casing. The cooling passages may be oriented to direct cooling flow through the passages towards the struts.

A turbine exhaust section comprising: an outer annular duct configured to receive exhaust gas from a turbine and including an outer casing housing and an inner casing housing; struts extending between the inner casing housing and the outer annular casing housing, wherein the struts extend through the outer annular duct; an inner annular duct coaxial to the outer annular duct and configured to receive cooling air, wherein the inner annular duct provides cooling air to the inner casing housing, wherein the inner casing includes an outer wall with cooling passages for the cooling air, and each cooling passage extends through the outer wall to allow cooling air to flow to an outer surface of the outer wall, and the cooling passages are arranged on the inner casing such that a pair of the cooling passages is on opposite sides of each of the struts, and the cooling passages in each pair are equidistant to the corresponding strut.

DETAILED DESCRIPTION OF THE INVENTION

Figure 1:
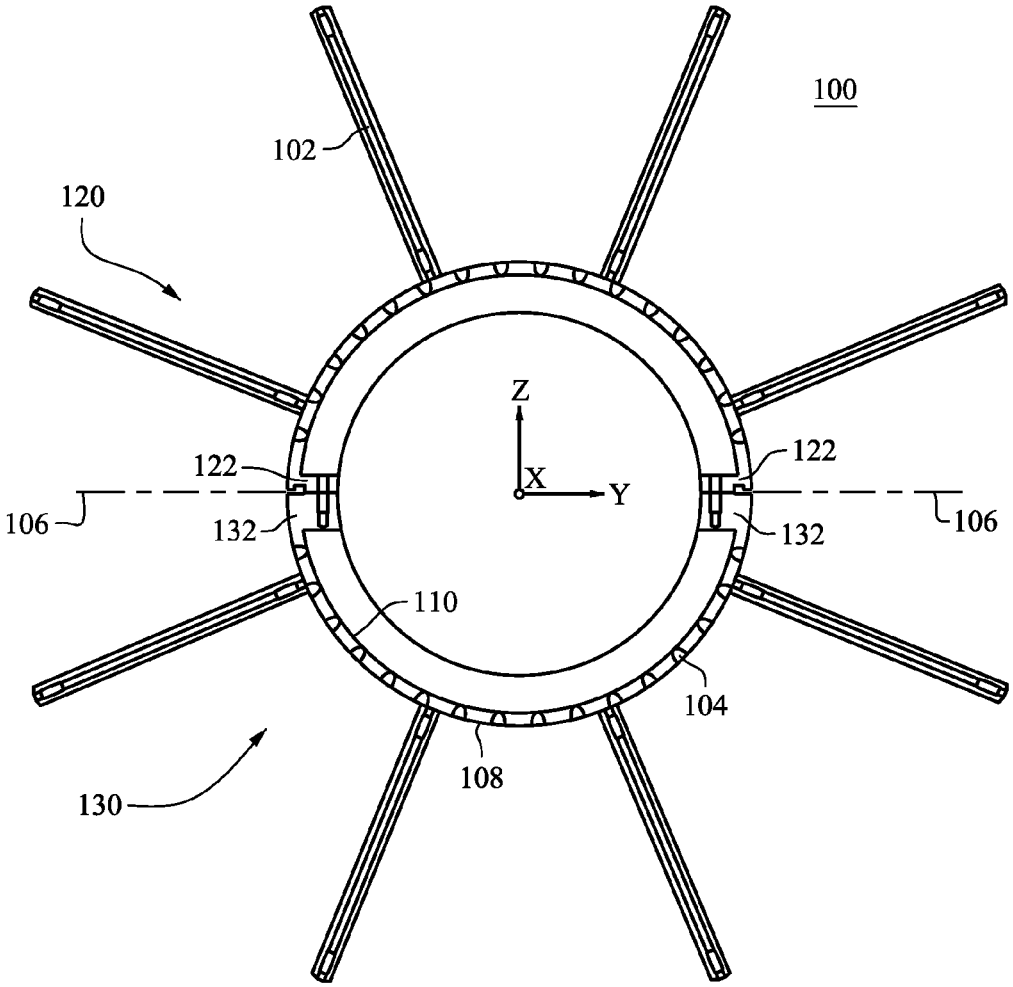
FIG. 1 (Prior Art)
FIG. 1 is a front view of a conventional front side of inner casing having cooling passages.

FIG. 1 shows a conventional inner casing 100 with cooling passages along the inner casing. The inner casing 100 includes semi-cylindrical casing housings, an upper inner casing housing 120 and a lower inner casing housing 130. The casing housings are joined at the split line 106 (e.g. a seam between the casing housings) by connecting two upper flanges 122 and two lower flanges 132 at the split line 106.

Struts 102 are located on an outer circumference 108 of the upper inner casing housing 120 and the lower inner casing housing 130 of the inner casing 100. The struts 102 located on the upper inner casing housing 120 and the lower inner casing housing 130 are symmetrical, and the struts 102 are typically equidistant from one another.

As used in a conventional gas turbine exhaust section, an inner casing is situated such that heated exhaust flow from the gas turbine exits the exhaust section by flowing past the struts on the inner casing. An exhaust flow may be in the X-direction, flowing past the struts. Cooling passages supply cooling flow that may be used to cool the struts that are heated by the exhaust flow, and to cool the inner casing that is heated by the exhaust flow and by rotation of a shaft it is coupled to.

On a conventional front side of inner casing 100, the cooling passages 104 are typically equidistant from one another. The cooling passages 104 communicate and extend between the inner circumference 110 of the inner casing 100 and the outer circumference 108 of the inner casing 100. Cooling flow may flow from an inner circumference 110 of the inner casing 100, through the cooling passages 104, and out of the outer circumference 108. The upper inner casing housing 120 has x number of cooling passages 104 that are equidistant from one another along the circumference of the inner casing 100 from the split line 106. The lower inner casing housing 130 has x number of cooling passages 104. The inner casing 100 in FIG. 1 has cooling passages 104 that do not coincide with the placements of the struts 102. Specifically, the cooling passages 104 are not uniformly positioned between the struts.

Figure 2:
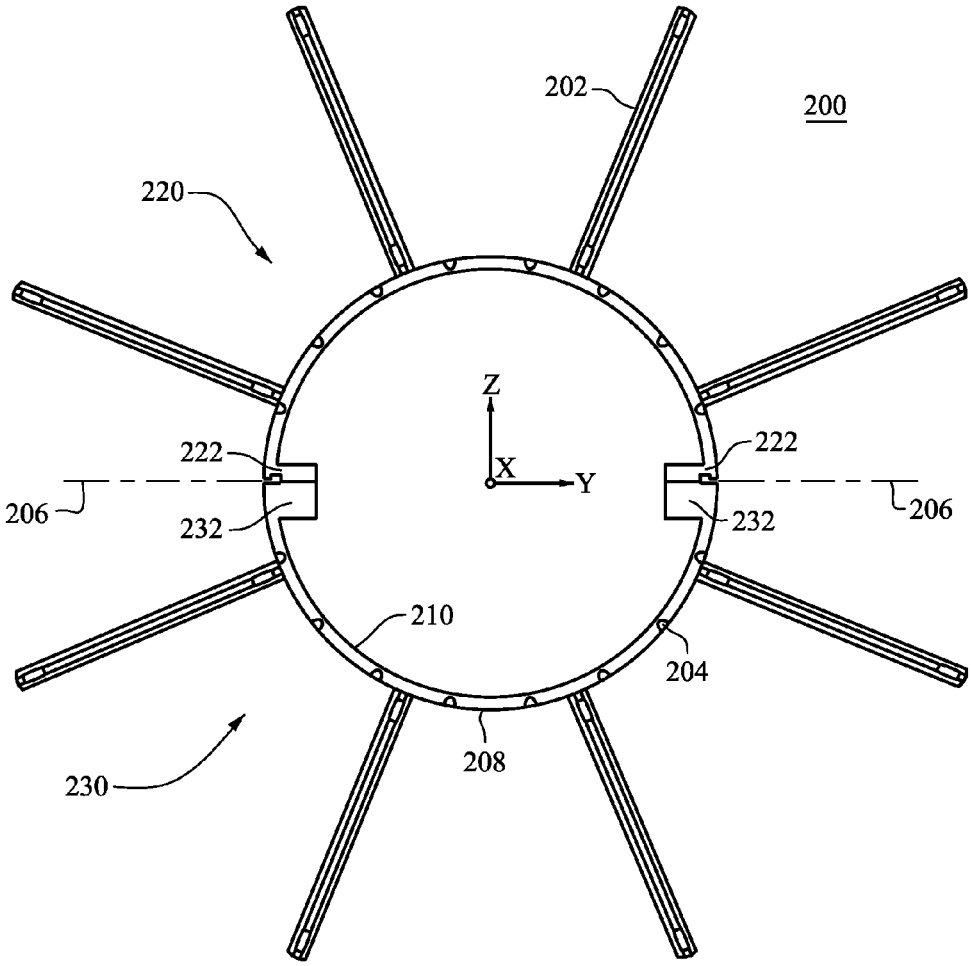
FIG. 2 (Prior Art)
FIG. 2 is a front view of a conventional back side of inner casing having cooling passages.

Similarly, FIG. 2 shows a back side of inner casing 200 with cooling passages 204. The back side of inner casing 200 also includes semi-cylindrical casing housings, an upper inner casing housing 220 and a lower inner casing housing 230. The back side of inner casing 200 includes cooling passages 204 that extend and communicate between the inner circumference 210 and the outer circumference 208. The cooling flow flows from the inner circumference 210 through the cooling passages 204 to supply cooling flow to the struts 202 located on the outer circumference 208 of the back side of inner casing 200.

The back side of inner casing 200 has a split line 206. At the split line 206, the upper inner casing housing 220 and the lower inner casing housing 230 are joined by connecting two upper flanges 222 and two lower flanges 232. The back side of inner casing 200 has 8 cooling passages 204 in the upper inner casing housing 220, and 8 cooling passages 204 in the lower inner casing housing 230. The arrangement of cooling passages 204 also do not align with the placements of the struts 202. That is, the cooling passages 204 are not uniformly positioned between the struts.

The misalignment of the struts and the cooling supply passages have been found to cause uneven distribution of cooling flow to each strut and the flanges of the inner casing 100 and 200. The uneven distribution of cooling passages may cause a high cooling flow variation and uneven cooling of the struts and the split line on an inner casing. Strut to strut flow variation may be as high as 60% on a conventional inner casing. Horizontal location struts, for example, would typically see a lower cooling flow rate due to a lesser number of supply passages per strut.

In addition, cooling flow around the split line is typically distraught due to the structure of an inner casing split line. The split line is typically a larger structure than other parts of the casing housing, which includes the upper and lower flanges without placement of cooling passages around the split line. Thus, the split line structure would distraught cooling flow around the split line due to the lower number of cooling passages.

A strut close to the split line would not receive adequate amount of cooling flow due to a lack of cooling passages in area. In comparison, other struts would have a higher cooling flow rate due to a higher number of cooling passages per strut in other areas of the inner casing. The uneven distribution of cooling passages with respect to the placements of the struts causes a reduction in reliability of the inner casing and struts in the turbine exhaust section due to inadequate cooling of the inner casing.

The present invention provides an arrangement of cooling passages that increases the uniformity of cooling of the inner casing. Even distribution of the cooling flow may help reduce the exhaust frame out of roundness, reduce the bearing drop that impacts the rotor vibrating, and improve the reliability of the inner casing and struts.

Figure 3:
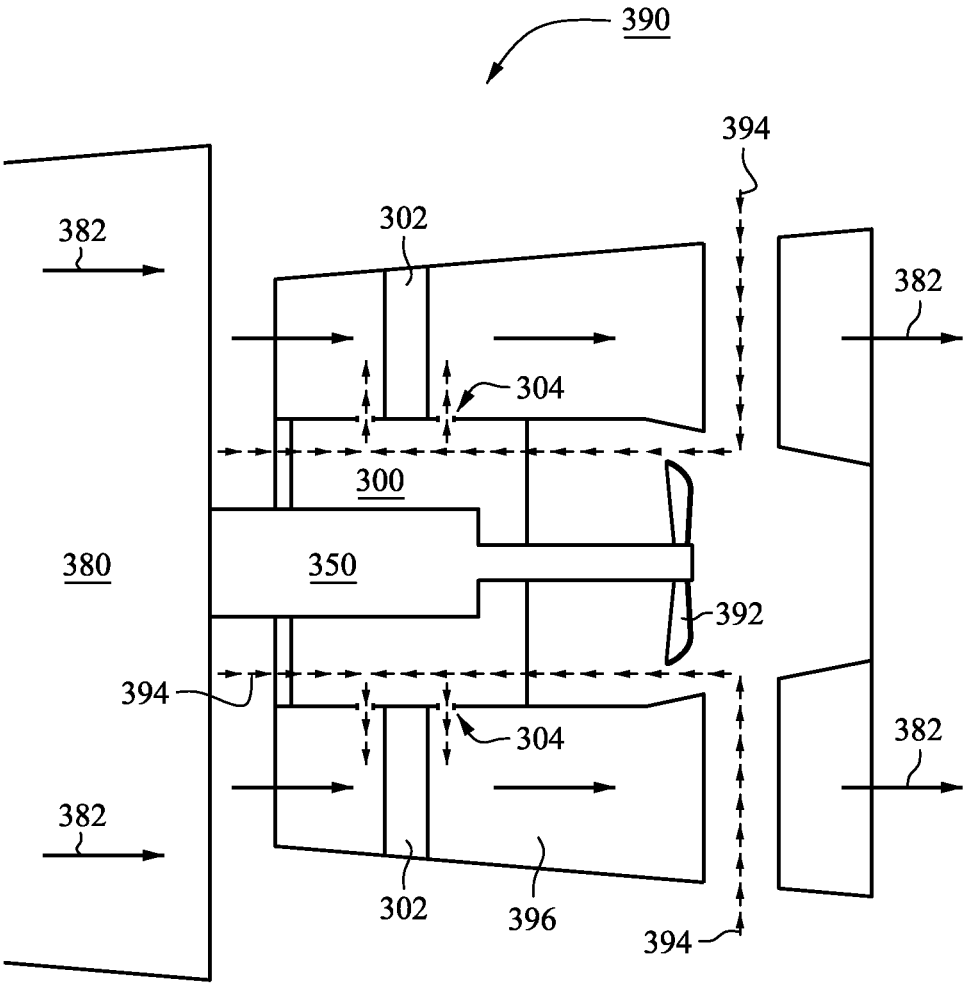
FIG. 3 is a side view of an exhaust section of a gas turbine having an inner casing comprising cooling passages uniformly arranged near the struts.

A gas turbine exhaust section 390 is shown with an inner casing 300 in FIG. 3. While in operation, a gas turbine engine compartment 380 would release a heated exhaust flow 382 that would flow from the turbine engine compartment 380 through an exhaust section 390. As the exhaust flow 382 flows through the exhaust path 396, the exhaust flow 382 may encounter struts 302 on an inner casing 300 and transfer heat from the exhaust flow 382 to the struts 302.

In the exhaust section 390, the inner casing 300 may be coupled to a shaft 350 that is rotatable. The shaft 350 may provide support for a set of propeller 392 that is used to draw in ambient air as cooling flow 394 for the exhaust section 390. Cooling flow 394 may convectively cool the exhaust section 390 and inner casing 300 to reduce thermal damage caused by the heat.

After the cooling flow 394 is drawn into the inner casing 300, the cooling flow 394 exits the inner casing 300 from cooling passages 304. The cooling flow 394 convectively cools the inner casing 300, including the struts 302, and then joins the exhaust flow 382 in the exhaust path 396 to exit the exhaust section 390.

Figure 4:
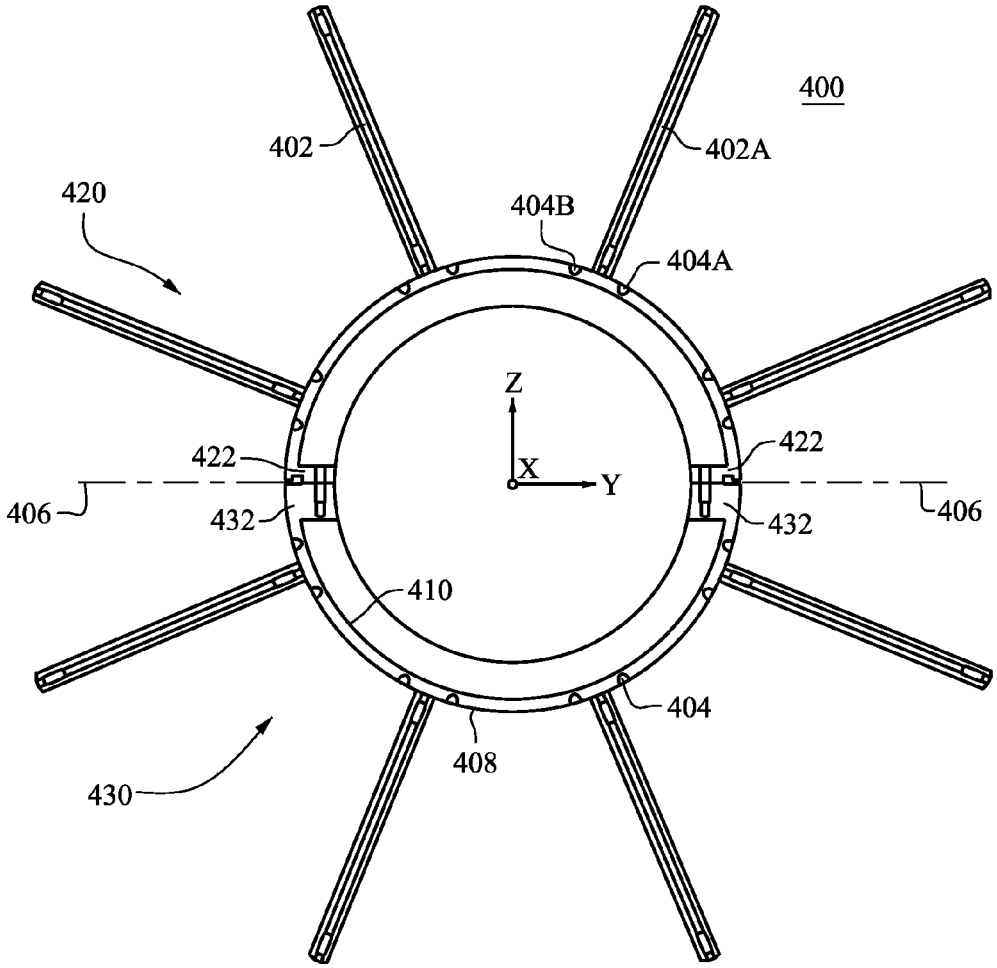
FIG. 4 is a front view of a front side of inner casing that shows an arrangement of cooling passages near the struts.

In FIG. 4, a forward of inner casing 400 has two casing housings, an upper inner casing housing 420 and a lower inner casing housing 430. The upper inner casing housing 420 and the lower inner casing housing 430 is joined at the split line 406 by connecting upper flanges 422 and lower flanges 432.

Each of the upper inner casing housing 420 and lower inner casing housing 430 has a plurality of struts 402 protruding from an outer circumference 408 of the inner casing 400. The inner casing 400 also includes cooling passages 404 that extend and communicate between the inner circumference 410 and the outer circumference 408 that allow cooling flow to pass through between the inner circumference 410 and the outer circumference 408.

On either side of each of the struts 402 on the outer circumference 408, there is at least one pair of cooling passages 404. The cooling passages 404 do not need to be equidistant from one another along the outer circumference 408 of the inner casing 400. However, the cooling passages 404 are to be similarly distanced from each of the struts 402 that it is adjacent to. For example, with respect to exemplary strut 402A, exemplary cooling passages 404A and 404B are placed on either side of the strut 402A. Exemplary cooing flow passages 404A and 404B are placed equidistantly from exemplary strut 402A.

Figure 5:
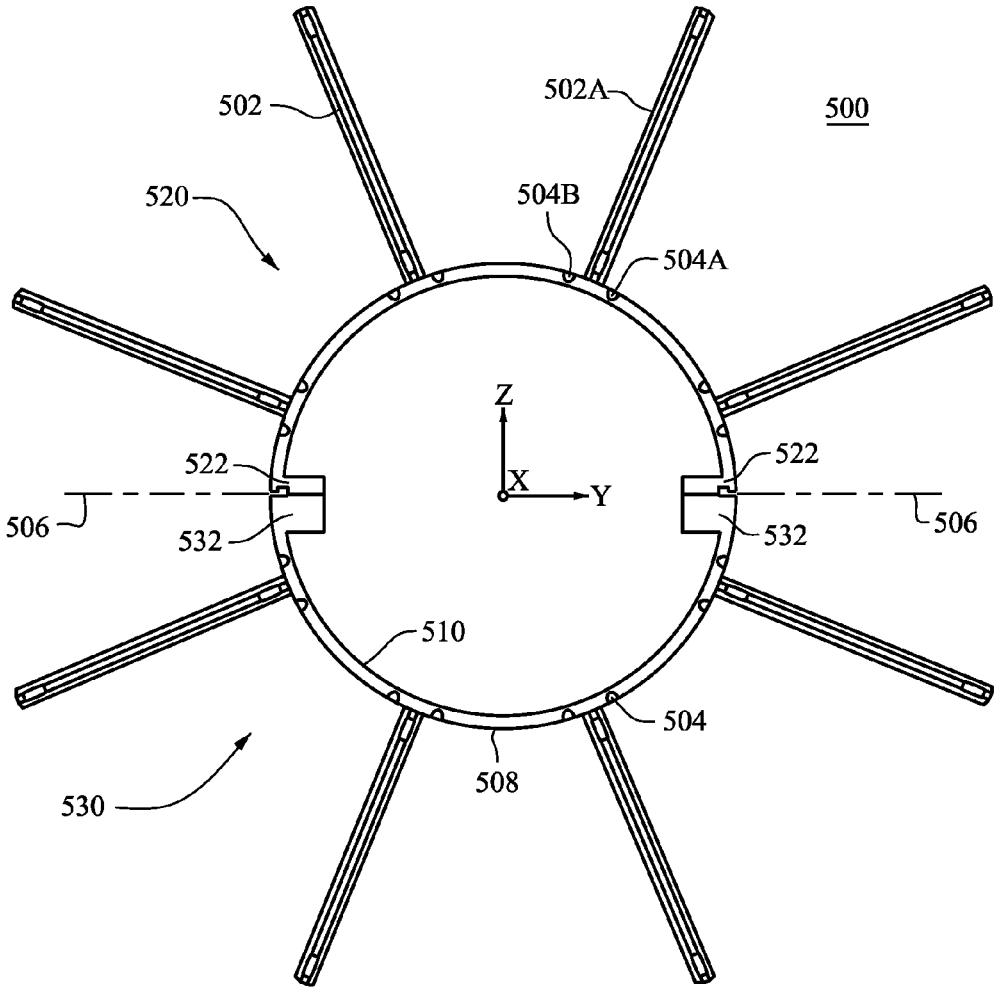
FIG. 5 is a front view of a back side of inner casing that shows an arrangement of cooling passages near the struts.

Similarly, in FIG. 5, a back side of inner casing 500 has an upper inner casing housing 520 and a lower inner casing housing 530. The upper inner casing housing 520 and the lower inner casing housing 530 is joined at the split line 506 by connecting upper flanges 522 and lower flanges 532. Each of the upper inner casing housing 520 and lower inner casing housing 530 has a plurality of struts 502 protruding from the outer circumference 508 of the inner casing 500.

The inner casing 500 has cooling passages 504 that extend and communicate between the inner circumference 510 and the outer circumference 508. On either side of each of the struts 502 on the outer circumference 508, there is at least one pair of cooling passages 504. The cooling passages 504 do not need to be equidistant from one another along the outer circumference 508, but the cooling passages 504 are to be similarly distanced from each of the struts 502 that it is adjacent to. For example, with respect to strut 502A, cooling passages 504A and 504B are placed on either side of the strut 502A. Cooing flow supply passages 504A and 504B are placed equidistantly from strut 502A.

In another embodiment, there may be more than four struts protruding from the outer circumference of an inner casing. The additional number of struts can be accommodated by placing the same number of cooling passages at similar distances on either side of each of the plurality of struts, such as described and shown FIGS. 4 and 5 above.

In an additional embodiment, there may be more than one pair of cooling passages on either side of each of the struts. There may be more than two cooling passages or more than three cooling passages on each side of the struts. The cooling passages are to be arranged symmetrically on either side of the struts to provide even and uniform cooling flow to each of the struts.

Figure 6:
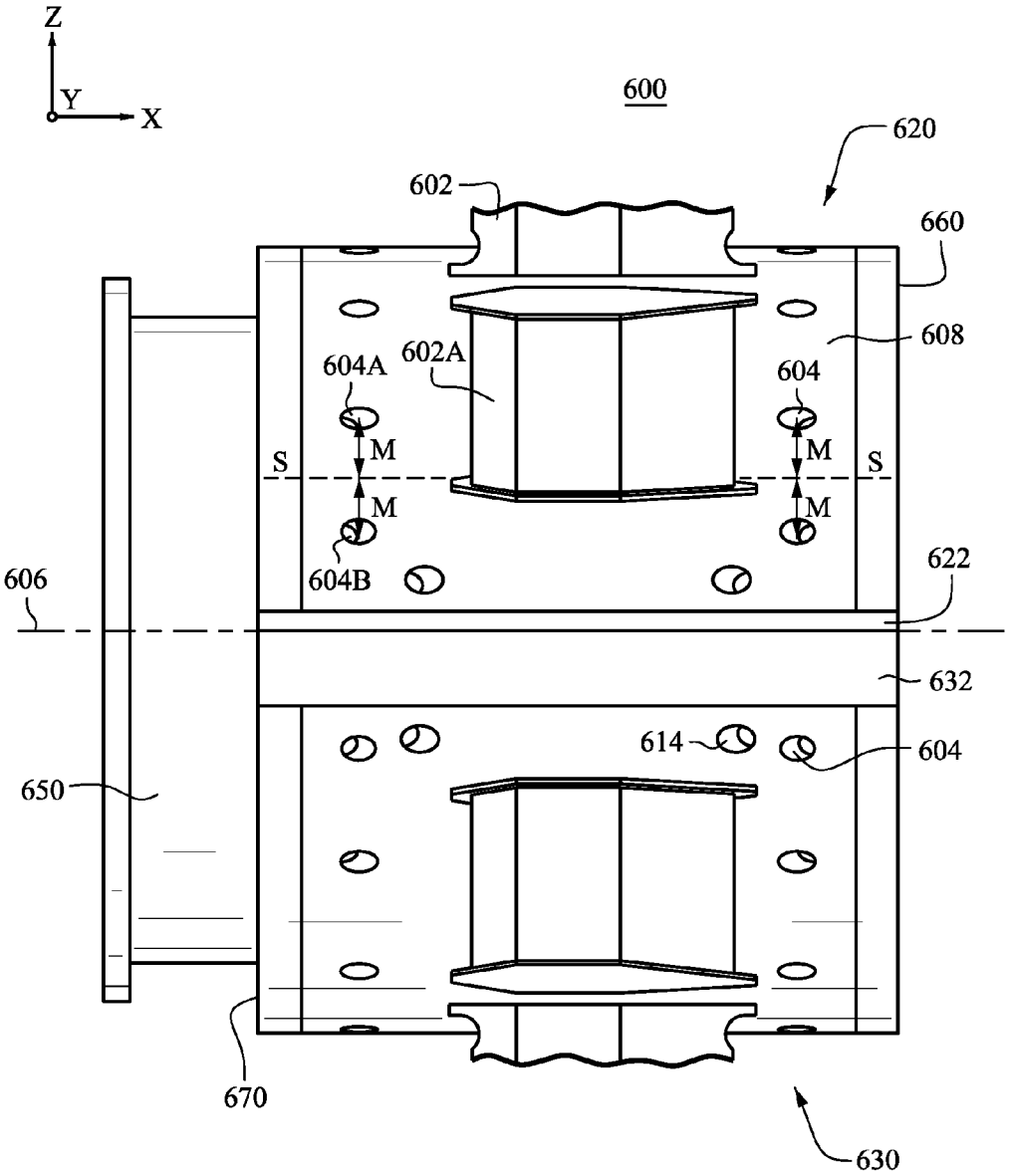
FIG. 6 is a side view that shows cooling passages and split line cooling passages.

Distances between struts and cooling passages are shown in FIG. 6, which provides a side view of an inner casing 600 that is coupled to a shaft 650 in a gas turbine. The inner casing 600 has an upper inner casing housing 620 and a lower inner casing housing 630. The upper inner casing housing 620 and the lower inner casing housing 630 is joined at the split line 606 by connecting upper flanges 622 and lower flanges 632. An outer circumference 608 of the inner casing 600 has a plurality of protruding struts 602.

The inner casing 600 comprises at least one pair of cooling passages 604 arranged on either side of each strut 602 along the outer circumference 608 of the inner casing 600. The cooling passages 604 may be arranged such that each pair of the cooling passages 604 are the same distance M away from the center line S of the struts 602 on the outer circumference 608.

For example, exemplary strut 602A has a center line S that extends from a center of mass of the strut towards the second rim 670. Exemplary cooling passages 604A and 604B are arranged on either side of the exemplary strut 602A along the second rim 670, and each of the exemplary cooling passages 604A and 604B is the same distance M away from the center line S. This arrangement places the exemplary passages 604A and 604B equidistantly on either side of the exemplary strut 602A.

Alternatively, there may be more than one pair of cooling passages 604 on either side of the struts 602. A number and pattern of cooling passages 604 on a first side of a strut 602 are symmetrical with respect to a number and pattern of cooling passages 604 placed on a second side of a strut 602 along the outer circumference 608.

Cooling passages 604 may be arranged along a first rim 660 of the inner casing 600 and along a second rim 670 of the inner casing 600. A first set of cooling passages 604 are arranged substantially the same distance away from the first rim 660, and a second set of cooling passages 604 are arranged a similar distance away from the second rim 670. Alternatively, the first set of cooling passages 604 may be arranged in a pattern along the first rim 660, and the second set of cooling passages 604 may be arranged in a similar pattern along the second rim 670 that is symmetrical to the first set of passages 604.

In another embodiment, in addition to the cooling passages 604 arranged adjacent to each strut 602, there are split line cooling passages 614 placed along to the split line 606 on both the upper inner casing housing 620 and the lower inner casing housing 630. The split line cooling passages 614 also extend and communicate between an inner circumference of the inner casing 600 and the outer circumference 608 of the inner casing 600. Arrangement of the cooling passages 604 and split line cooling passages 614 is further shown in FIG. 7.

Figure 7:
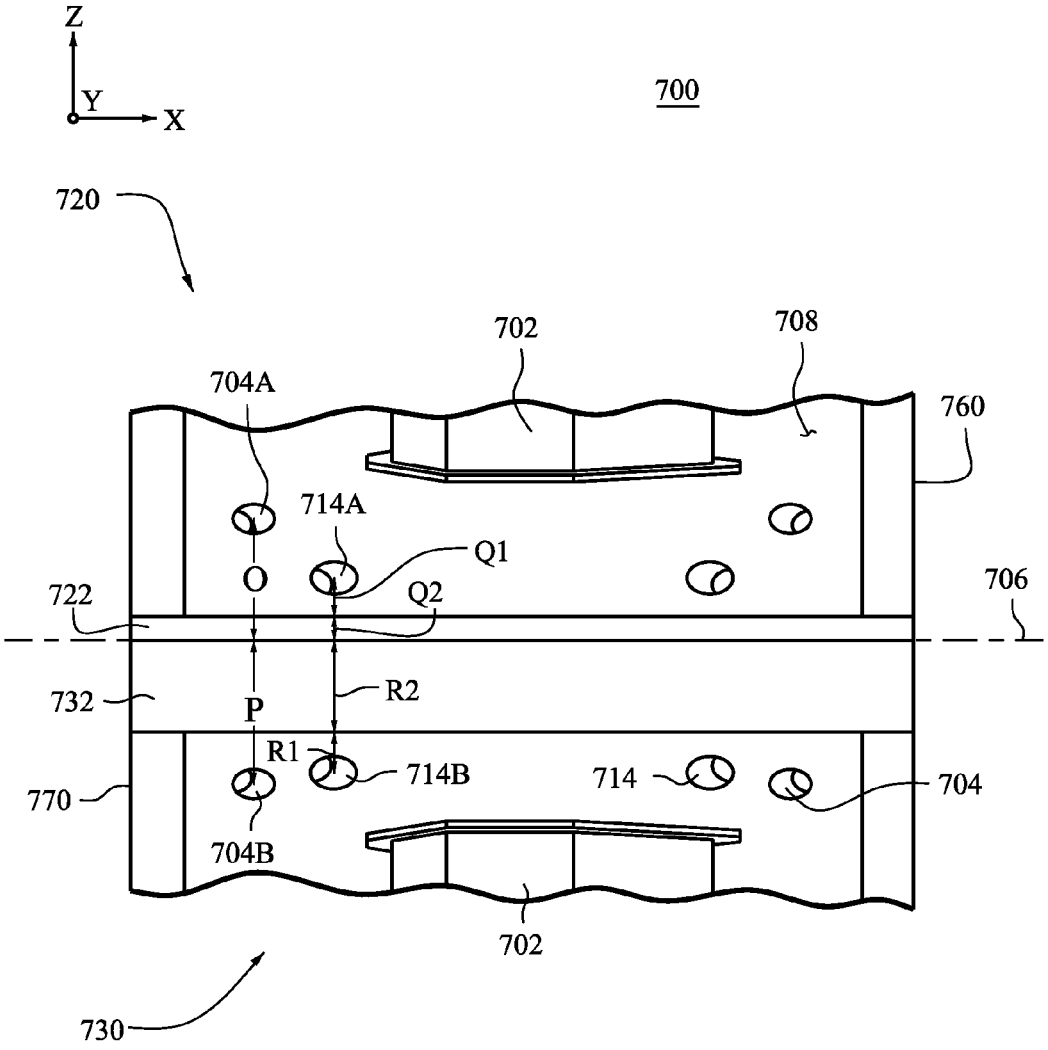
FIG. 7 is a magnified view of an inner casing with cooling passages uniformly arranged on either side of the split line of the inner casing

An inner casing 700, is magnified in FIG. 7 to show the split line 706 with a strut 702 that is adjacent to the split line 706, and a first rim 760 and a second rim 770 of the inner casing 700. The inner casing 700 comprises an upper flange 722 on an upper inner casing housing 720 and a lower flange 732 on a lower inner casing housing 730. The upper flange 722 and the lower flange 732 joins at the split line 706 to form the inner casing 700.

The upper flange 722 has a thickness of Q2 along the outer circumference 708. Similarly, the lower flange 732 has a thickness of R2 along the outer circumference 708. Split line cooling passages 714 are placed in close proximity to the split line 706, adjacent to the upper flange 722 and the lower flange 732. Split line cooling passages 714 are placed a distance Q1 away from an edge of the upper flange 722 that is immediately adjacent to the cooling passages 714. Similarly, split line cooling passages 714 are placed a distance R1 away from an edge of the lower flange 732 that is immediately adjacent to the cooling passages 714. The distances Q1 and R1 can be the same, or different if desired.

Nonetheless, split line cooling passages 714 may not have the same distance away from the split line 706 on the upper inner casing housing 720 and the lower inner casing housing 730 if a thickness of the upper and lower flanges 722 and 732 are different. The split line cooling passages 714 are placed to aid in the cooling of the upper and lower flanges 722 and 732.

Unlike the split line cooling passages 714, the cooling passages 704 are not placed with respect to the split line. The cooling passages 704 may not be the same distances away from the upper flange 722 as from the lower flange 732, and may not be the same distances away from the split line 706. Cooling passages 704 are placed according to the placements of the struts 702.

For example, cooling passages 704 may be a distance O away from the split line 706 on the upper inner casing housing 720, and the cooling passages may be a distance P away from the split line 706 on the lower inner casing housing 730. Distance O and distance P may be the same if the struts are placed equidistantly with respect to the outer circumference 708, or distance O and distance P may not be the same if the struts are not placed equidistantly with respect to the outer circumference 708.

In addition, the split line cooling passages 714 may be placed symmetrically on the upper inner casing housing 720 and the lower inner casing housing 730. For example, the exemplary cooling hole 704A on the upper inner casing housing 720 are placed across the split line 706 from the exemplary cooling hole 704B on the lower inner casing housing 730. Exemplary cooling hole 704A and exemplary cooling hole 704B are placed symmetrically. Similarly, the exemplary split line cooling hole 714A is placed across the split line 706 from the exemplary cooling hole 714B. The exemplary split line cooling hole 714A and exemplary split line cooling hole 714B are placed symmetrically.

A first set of cooling hole 704 and split line cooling hole 714 may be placed close to the first rim 760, and a second set of cooling hole 704 and split line cooling hole 714 may be placed close to the second rim 770. The first set and the second set are placed symmetrically.

Alternatively, more than two split line cooling passages may be placed adjacent to the upper flange and the lower flange. A plurality of split line cooling passages may be located symmetrically on an upper inner casing housing and a lower inner casing housing such that the split line upper and lower flanges are cooled uniformly. The split line cooling passages may be placed equidistantly along the upper and lower flanges.

Figure 8:
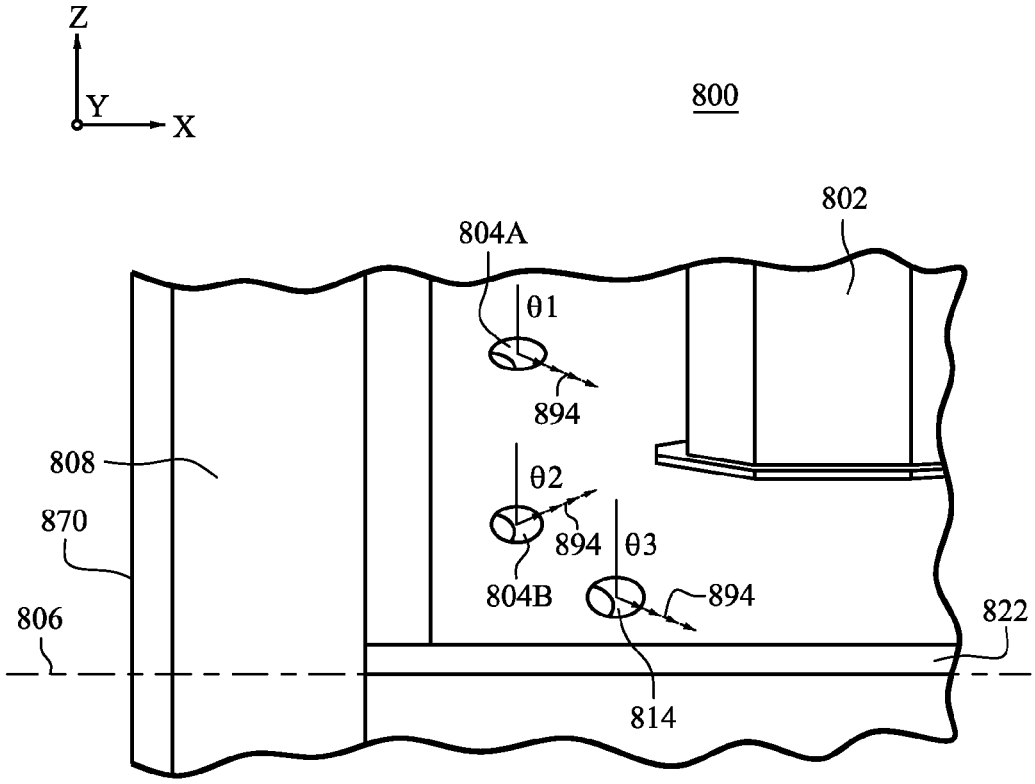
FIG. 8 is a magnified view of an inner casing with cooling passages and split line cooling passages.

FIG. 8 shows two exemplary cooling passages 804A and 804B adjacent to an exemplary strut 802 that have a size and orientation which may be advantageous in providing cooling flow to the struts and the upper and lower flanges at the split line. As shown in FIGS. 4 and 5, cooling passages extend between an inner circumference of the inner casing and an outer circumference of the inner casing. Thus the exemplary cooling passages 804A and 804B allows cooling flow 894 to pass through from the inner circumference to the outer circumference 808 of the inner casing 800.

The exemplary cooling passages 804A and 804B are placed on either side of the strut 802, and the exemplary cooling passages 804A and 804B are oriented to direct cooling flow 894 towards the strut 802. The exemplary cooling hole 804A are oriented at an angle θ1 relative to an axis Z of the cooling hole, and the cooling hole 804B are oriented at an angle θ2 relative to axis Z.

For example, angles θ1 and θ2 may be symmetrically placed adjacent to the strut 802. The exemplary cooling passages 804A and 804B are oriented such that the cooling flow 894 passes through and is directed towards the strut 802. Cooling passages 804A and 804B may be angled at 15, 30, 45, 60, 75, 90, 105, 120, 135, 150, or 165 degrees relative to an axis Z extending through the center of the hole.

In addition, the cooling passages 804A and 804B may be in any kind of shape, such as conical, cylindrical, rectangular, spherical, hemispherical, and combinations thereof.

Exemplary cooling passages 804A and 804B may be placed such that they are equidistant from the second rim 870 of the inner casing 800, and also equidistant from the strut 802 on the outer circumference 808.

The inner casing 800 may also additionally comprise split line cooling passages 814. The split line cooling passages 814 are oriented at an angle θ3 towards the split line 806, and are placed adjacent to one of the flanges on the split line 806, such as the upper flange 822. The split line cooling passages 814 may be in any kind of shape, such as conical, cylindrical, rectangular, spherical, hemispherical, and combinations thereof.

Split line cooling passages 814 may also be angled at 15, 30, 45, 60, 75, 90, 105, 120, 135, 150, or 165 degrees relative to the axis Z. Preferably, the split line cooling passages 814 are oriented such that the cooling flow 894 passing through the split line cooling passages 814 is directed towards the split line 806.

Even though FIG. 8 shows two cooling passages 804A and 804B that may be used to supply cooling flow to the exemplary strut 802, the same limitations may be applied to other cooling passages to other struts on the inner casing 800 that are not shown in FIG. 8. Similarly, the inner casing 800 may comprise other split line cooling passages 814 to supply more cooling flow to the split line 806.

Advantages of the present invention include providing improved cooling of the inner casing, specifically at the roots of the struts and the flanges at the split line where the mass are different than at other locations on the inner casing. Cooling of struts 902 have been analyzed using an inner casing 900 shown in FIG. 9.

Figure 9:
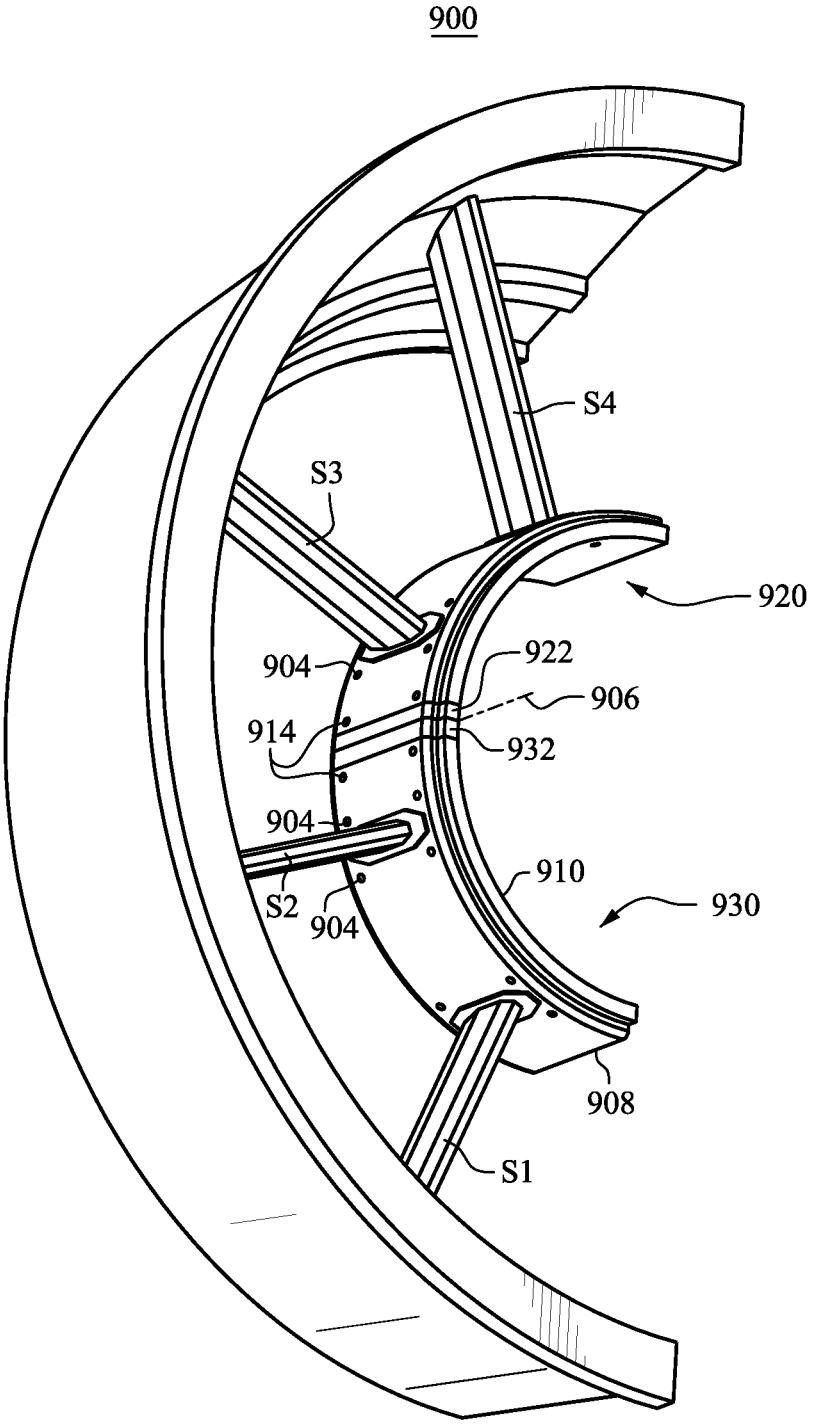
FIG. 9 is perspective view of an inner casing with cooling hole and split line cooling hole arrangements.

FIG. 9 shows an inner casing 900 that comprises an upper inner casing housing 920 and a lower inner casing housing 930 that are joined at the split line 906. The upper inner casing housing 920 includes 2 struts, S3 and S4, and an upper flange 922. Cooling passages 904 are placed on either side of the struts S3 and S4, and split line cooling passages 914 are placed adjacent to the upper flange 922.

Similarly, the lower inner casing housing 930 includes 2 struts, S1 and S2, and a lower flange 932. Cooling passages 904 are placed on either side of the struts S1 and S2, and split line cooling passages 914 are placed adjacent to the lower flange 932. Cooling flow passes through the cooling passages 904 and the split line cooling passages 914 from an inner circumference 910 of the inner casing 900 to an outer circumference 908 of the inner casing 900. The cooling flow is direct towards the struts S1, S2, S3 and S4 through the cooling passages 904, and the cooling flow is directed towards the flanges 922 and 932 through the split line cooling passages 914.

An analysis was conducted to determine the variations in cooling flow for different types of inner casing: a conventional inner casing, an inner casing comprising the inventive cooling hole arrangement, and an inner casing comprising the inventive cooling hole and split line cooling hole arrangements.

It was found that for a conventional inner casing, such as the inner casings 100 or 200 shown in FIGS. 1 and 2, the struts on the inner casing could see a strut to strut cooling flow variation that is as high as 60%. By positioning the cooling passages equidistantly on either side of each of the struts, cooling flow variation from strut to strut may be reduced to about 30%. Cooling flow variation from strut to strut may be reduced to about 15% for an inner casing that includes split line cooling passages placed adjacent to the split line in addition to cooling passages placed equidistantly on either side of each of the struts.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An inner casing assembly for a turbine comprising:

an annular inner casing having an upper inner casing housing with an upper flange, and a lower inner casing housing with a lower flange, the upper flange and the lower flange are joined at a split line to form the annular inner casing, cooling passages extending through a wall of the annular inner casing from a source of cooling fluid to an outer surface of the wall of the annular inner casing, the cooling passages are not equidistantly arranged around a circumference of the annular inner casing, and struts extending outward from the outer surface of the annular inner casing, each of the struts has a center of mass, wherein the cooling passages are arranged on the annular inner casing such that for a first pair of the cooling passages, the cooling passages are on opposite sides of each of the struts, and the cooling passages in the first pair are equidistant to the corresponding strut, the distance is measured with respect to a center line S that extends from the center of mass of the strut towards a rim of the annular inner casing, wherein the cooling passages include a second pair of cooling passages in which the passages are on opposite sides of a split line extending in an axial direction through the outer surface of the inner casing, and in the second pair of cooling passages, the cooling passages are placed equidistantly away from edges of the upper flange and the lower flange that do not abut, wherein the first and second pairs of cooling passages are at different distances away from the split line.

2. The inner casing assembly of claim 1 wherein a third pair of cooling passages on opposite sides of the split line are each equidistant from the split line.

3. The inner casing assembly of claim 1 wherein the cooling passages are not equidistantly away from a rim of the annular inner casing.

4. The inner casing assembly of claim 1 wherein the cooling passages include cooling passages arranged in annular arrays in front of and behind the struts along an axis of the annular inner casing.

5. The inner casing assembly of claim 1 wherein the second pair of cooling passages are oriented to direct cooling flow towards the struts, and the second pair of cooling passages are oriented to direct cooling flow towards the upper and lower flanges at the split line.

6. A turbine exhaust section comprising:

an outer annular duct configured to receive exhaust gas from a turbine and including an outer casing housing and an inner casing housing, the inner casing housing having an upper inner casing housing with an upper flange and a lower inner casing housing with a lower flange, the upper inner casing housing and the lower inner casing housing are joined by abutting the upper flange to the lower flange to form a split line;

struts extending between the inner casing housing and the outer casing housing, wherein the struts extend through the outer annular duct, and each of the struts has a center of mass;

an inner annular duct coaxial to the outer annular duct and configured to receive cooling air, wherein the inner annular duct provides cooling air to the inner casing housing, wherein the inner casing housing includes an outer wall with cooling passages for the cooling air, and each cooling passage extends through the outer wall to allow cooling air to flow to an outer surface of the outer wall, and the cooling passages are arranged on the inner casing such that in a first pair of the cooling passages, the cooling passages are is on opposite sides of each of the struts, the cooling passages in the first pair are equidistant to the corresponding strut, the distance is measured with respect to a center line S that extends from the center of mass of the strut towards a rim of the inner casing housing, wherein the cooling passages include a second pair of cooling passages in which the passages are on opposite sides of a split line extending in an axial direction through the outer surface of the inner casing housing, and in the second pair the cooling passages are placed equidistantly away from non-opposing edges on the upper flange and the lower flange, wherein the cooling passages are not equidistantly arranged around a circumference of the inner casing housing, and the first and second pairs of cooling passages are at different distances away from the split line.

7. The turbine exhaust section of claim 6 wherein a third pair of cooling passages on opposite sides of the split line are each equidistant from the split line.

8. The turbine exhaust section of claim 6 wherein the cooling passages are symmetrically arranged about a vertical axis.

9. The turbine exhaust section of claim 6 wherein the second pair of cooling passages are oriented to direct cooling flow towards the split line.

10. The turbine exhaust section of claim 6 wherein the cooling passages are not equidistantly away from a rim of the inner casing housing.

11. The turbine exhaust section of claim 6 wherein the cooling passages include cooling passages arranged in annular arrays in front of and behind the struts along an axis of the inner casing housing.

12. The turbine exhaust section of claim 6 wherein the first pair of cooling passages are oriented to direct cooling flow towards the struts.

* * * * *